United States Patent [19]

Edelhoff

[11] Patent Number: 4,917,257

[45] Date of Patent: Apr. 17, 1990

[54] GARBAGE CAN

[75] Inventor: Gustav D. Edelhoff, Iserlohn, Fed. Rep. of Germany

[73] Assignee: Edelhoff M.S.T.S., Dusseldorf, Fed. Rep. of Germany

[21] Appl. No.: 184,884

[22] Filed: Apr. 22, 1988

[30] Foreign Application Priority Data

Apr. 22, 1987 [DE] Fed. Rep. of Germany ..... 3713513

[51] Int. Cl.[4] ..... B65F 1/12

[52] U.S. Cl. ..... 220/1 T

[58] Field of Search ..... 220/1 T; 414/408

[56] References Cited

U.S. PATENT DOCUMENTS

| | | | |
|---|---|---|---|
| 4,351,539 | 9/1982 | Rodolakis | 220/1 T |
| 4,712,701 | 12/1987 | Durkan | 220/1 T |

FOREIGN PATENT DOCUMENTS

| | | | |
|---|---|---|---|
| 185382 | 6/1986 | European Pat. Off. | 220/1 T |
| 3536139 | 4/1987 | Fed. Rep. of Germany | 220/1 T |
| 2584051 | 1/1987 | France | 220/1 T |

*Primary Examiner*—Robert G. Nilson

*Attorney, Agent, or Firm*—Morgan & Finnegan

[57] ABSTRACT

This invention relates to a garbage can comprising a barrellike can body, which is substantially rectangular in cross-section and tapers downwardly to its bottom, a cover, which is hinged to the top rear edge of the can body, a receptacle, which is provided adjacent to the front edge of the top opening of the can body and is adapted to receive a grab claw of a lifting and tilting mechanism, and a pair of axially aligned casters, which are eccentrically mounted adjacent to the bottom of the can body. In accordance with the invention, the bottom of the can body is connected by an inclined wall portion of the rear wall of the can body, said inclined wall portion and the bottom of the can body are formed with laterally disposed re-entrant portions, which constitute recesses, and the casters are rotatably mounted on a common axle or on aligned stub axles fitted in holders and are disposed inside the imaginary envelope of the can body which surrounds the inclined wall portion and the recesses.

19 Claims, 5 Drawing Sheets

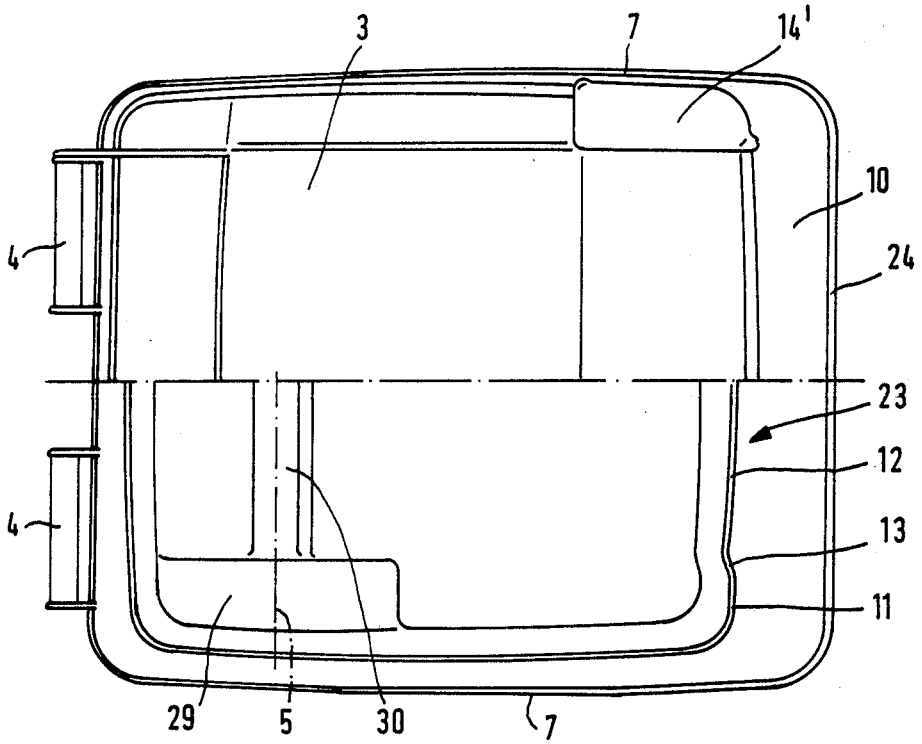
FIG. 3
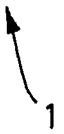

GARBAGE CAN

BACKGROUND OF THE INVENTION

1. Field of the Invention

This invention relates to a garbage can comprising a barrellike can body, which is substantially rectangular in cross-section and tapers downwardly to its bottom, a cover, which is hinged to the top rear edge of the can body, a receptacle, which is provided adjacent to the front edge of the top opening of the can body and is adapted to receive a grab claw of a lifting and tilting mechanism, and a pair of axially aligned casters, which are eccentrically mounted adjacent to the bottom of the can body.

2. Description of the Prior Art

Garbage cans of that kind are known, e.g., from German Utility Model Specification No. 69 09 469 and Published German application No. 34 46 860. Whereas those known garbage cans can conveniently be handled because they can be rolled on their casters like a sack barrow when they have been tilted about the casters axis, they have the disadvantage that they cannot be nested unless the casters and their axles have been removed. For this reason the casters cannot be mounted in the factory but must be mounted on the can when it has been delivered to its site of use.

SUMMARY OF THE INVENTION

For this reason, it is an object of the invention to provide a garbage can which is of the kind described first hereinbefore and which can be nested even when it is completely assembled.

That object is accomplished in accordance with the invention in that the bottom of the can body is connected by an inclined wall portion to the rear wall of the can body, the inclined wall portion and the bottom of the can body are formed with laterally disposed re-entrant portions, which constitute recesses, and the casters are rotatably mounted on a common axle or on aligned stub axles fitted in holders and are disposed inside the imaginary envelope of the can body which surrounds the inclined wall portion and the recesses. Because in the garbage can in accordance with the invention the casters do not protrude from the imaginary envelope of the garbage can, the garbage cans can be nested for storage even when the casters have been mounted and in such a manner that the swung-back covers overlap.

As a result, the garbage cans in accordance with the invention can be stored and transported within a small space.

Independent protection is claimed for a garbage can in which the can body is integrally formed below its top opening with an annular peripheral jacket, which is connected by stiffening ribs to the upper wall portions of the can body, and a pocket for receiving the grab claw is provided in the space between the front wall of the can body and the front portion of the jacket. That jacket constitutes an enlarged portion, which protrudes outwardly from the upper portion of the can body so that the nested garbage cans can easily be separated because the nested cans are supported at the jackets and cannot become wedged by being nested to an excessive depth. The protruding jackets limit the load which is exerted on the can bodies of the nested cans and defines the spacing of the nested garbage cans.

The protruding jacket can be imagined to have been formed by a reverse folding of an upward extension of the can body.

The stiffening ribs are suitably approximately parallel to each other and to the longitudinal edges of the can body. In that case the can body can be manufactured in a simple manner by injection molding from plastic and the stiffening ribs will facilitate the removal of the molding from the mold.

Independent protection is also claimed for a garbage can in which the receiving pocket conforms to an approximately triangular grab claw, which as an upwardly facing tip and a substantially flat rear surface and a spherifically curved front surface, which is upwardly inclined from those sides of the triangle which meet at the tip and which front surface constitutes, e.g., a segment of a cone, which segment is defined by an eccentric plane that is parallel to the axis of the cone.

A grab claw of that kind is known, e.g., from European Patent Publication No. 163,859.

The pocket for receiving the grab claw is suitably so designed that the ribs provided on the front wall of the can body are cut away to form inwardly and downwardly facing edges, which conform to the contour of the approximately triangular receiving pocket that has a spherically curved front surface.

A special problem arising in connection with garbage cans, particularly if they are made by injection molding from plastic, resides in that it is difficult to give them the required stiffness and endurance limit under loads which are exerted as the cans are picked up and tilted by means of the grab claw. For this reason, it is a further feature of the invention that the front wall of the can body is inwardly re-entrant from the side edges and the transitions between the re-entrant portion of the front wall and the side edges are constituted by steps which have a flat S-shaped configuration in horizontal section and constitute stiffening beads. When the triangular grab claw having a spherically curved front surface enters the receiving pocket of a can that is to be emptied, the spherically curved front surface of the grab claw can bear on the inwardly and downwardly facing edges of the correspondingly shaped stiffening ribs and the enlarged lower base of said claw can bear on those edge portions of the front surface which are stiffened by the stiffening beads so that the forces which are exerted as the can is tilted can be applied to the can in a favorable manner and the overall loads on the can body will be reduced. Independent protection is claimed also for that further feature of the invention, which has the result that the lateral portions of the front wall of the can body protrude and are separated by steps from the intermediate portion of the front wall of the can body. As a result, the grab claw will not contact the soft intermediate portion of the front wall of the can body but will bear on the edge portions of the front wall of the can body adjacent to the generally vertically extending steps. Said generally vertical steps will be closer to those edges which are formed in the can body between its front wall and the two side walls so that the forces exerted by the grab claw on the can body will be applied more favorably to the can body and the load on the can body will be decreased.

Because in accordance with the invention, the receiving pocket is disposed between the front wall of the can body and the annular jacket, the receiving pocket will not arch outwardly whenever the can is picked up and during the tilting of the can, it can be reliably locked at its top edge by suitable locking means provided on the lifting and tilting mechanism. The vertical stiffening ribs, which are cut away to form edges which conform to the contour of the grab claw, will promote a desirable application of forces. In addition to promoting a favorable application of force, the stiffening ribs facilitate the manufacture of the can by injection molding from plastic.

In known cans the grab claw can bear on the front wall of the can body in approximate linear contact therewith so that the front wall of the can body will continually be arched or buckled. That continual arching or buckling may eventually result in a fatigue failure of the front wall and at a low temperature may result in a splitting of the plastic can material. These disadvantages are avoided by the design in accordance with the invention.

Owing to the generally vertically extending steps between the intermediate portion of the front wall of the can body and its side portions the can is formed on its front side with linear design features, which may be utilized as a reference feature and/or as a target feature for sensory and/or video-optical recognition systems, as has been described in Published German Application No. 35 33 168. The garbage can in accordance with the invention is thus formed with integrated features for an automatic detection of the position of the can.

The steps are preferably S-shaped and wave-shaped. That special wave shape of the transitions between the side walls of the can body and the intermediate portion of its front wall ensures that the rear surface of the grab claw will contact the front wall of the can body along laterally disposed lines of surfaces when the can is to be picked up whereas the soft intermediate portion of the front wall of the can will not be loaded by pressure applied by portions of the grab claw.

The spherically curved front surface of the triangular grab claw will bear on the stiffening ribs at their inner edges, which conform to the contour to the engaging surface of the grab claw. For the purpose the ribs are shorter in the intermediate portion of the receiving pocket and longer in the outer portions of the receiving pocket. The ribs progressively increase in length from the center toward both sides in conformity to the contour of the grab claw. Because the vertical ribs disposed within the front pocket of the receiving pocket constitute a structure which conforms to the spherically curved engaging surface of the grab claw, the grab claw can easily slide into and will exactly fit the receiving pocket even when the grab claw has been soiled.

Shoulder-forming bars 10 are preferably provided on the outside of the upper portions of the side walls of the can body. The bars may be connected to the side walls by spaced apart vertical ribs. The special rib structure provided on both sides in the cavity between the receiving pocket and the wall of the can body will ensure that the forces exerted by the grab claw as the can is picked up and tilted will be uniformly transmitted from the front wall of the pocket to the can body.

The special rib structure also facilitates the extraction of the can from the injection mold in a downward direction without a need for sliding carriages in the mold. As a result, inexpensive molds can be used and the can can be made at low cost by injection molding from plastic. The cycle time can also be reduced so that the costs of manufacturing the garbage can will be further reduced.

The jacket is suitably narrower on the rear than on the front side of the can and the side portions of the jacket may be formed with an inclined step between the wider portion and the narrower portion.

Independent protection is also claimed for a further feature of the invention which resides in that the can body is formed at its top edge with an inwardly offset upstanding annular rib, which in the closed can is surrounded by the depending edge flange of the flanged cover. Because an upstanding annular rib protrudes above the top edge of the can body and in the closed can is surrounded by the depending edge flange of the cover, a narrow air gap is formed between the edge flange of the closed cover and the upstanding annular rib and the noise generated by the impact of the cover on the top edge of the can body will be substantially reduced because the air can escape only gradually through the laybrinthlike gap as the cover falls onto the can body. An additional advantage afforded by that feature resides in that the overlap presents an ingress of vermin.

A further desirable feature resides in that the cover is formed with a handle recess in at least one of its front corner portions. Owing to those specially designed handle recesses the cover can be made in a mold having no sliding carriage. The cover is suitably made also by injection molding from plastic.

BRIEF DESCRIPTION OF THE DRAWING

FIG. 3 is a top plan view showing the garbage can of FIGS. 1 and 2.

DETAILED DESCRIPTION OF THE PREFERRED EMBODIMENT

Figure 1:
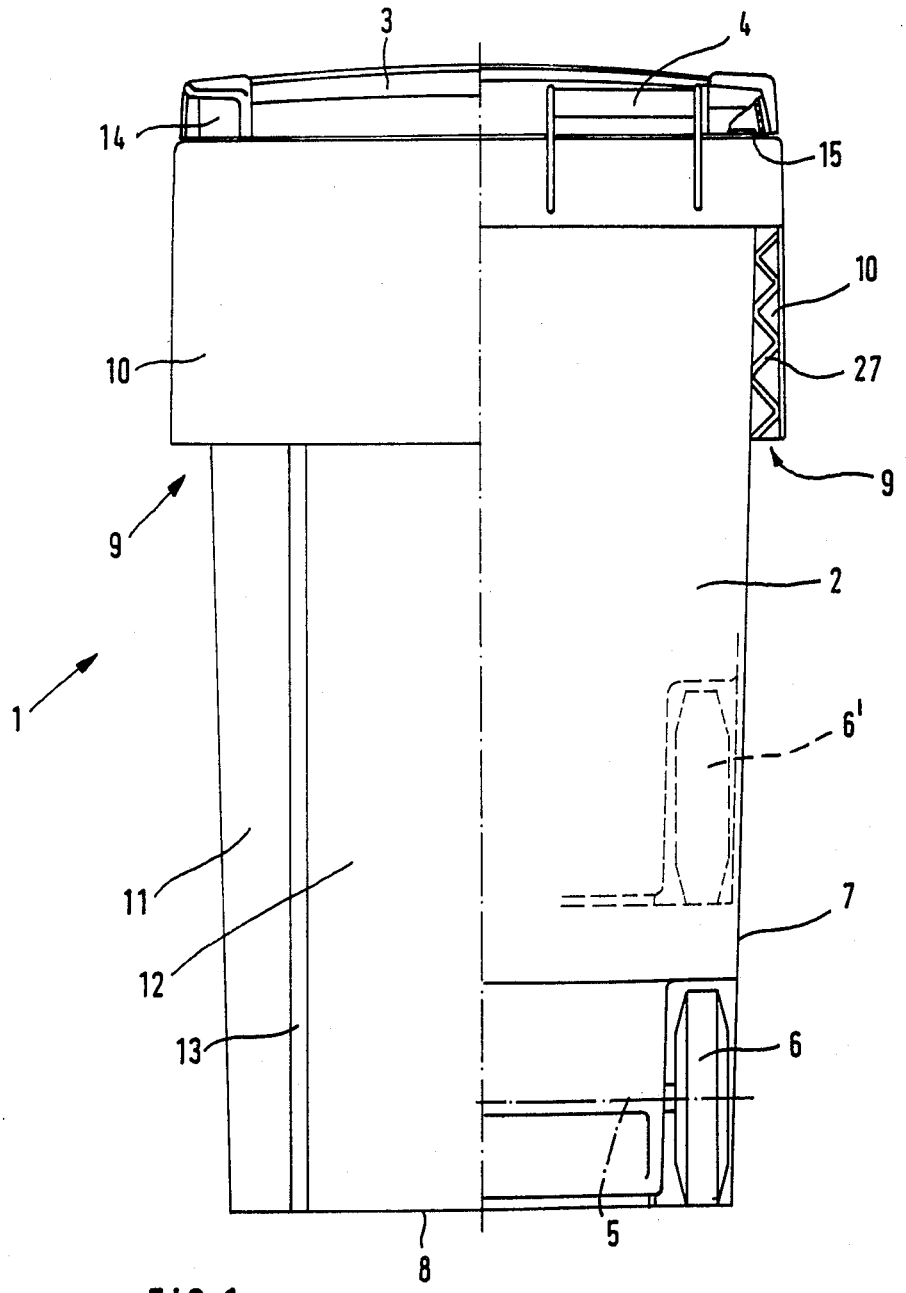
FIG. 1 is an elevation showing a garbage can, which is shown in a front elevation on the left of the center line and in a rear elevation on the right of the center line.

An illustrative embodiment of the invention will now be described more in detail with reference to the Drawings.

The garbage can 1 shown in the Drawing consists of a can body 2 and a cover 3, which is hinged to the can body 2 on an axis 4.

The garbage can is shown in FIG. 1 in a front elevation on the left and in a rear elevation on the right. A caster 6 which is rotatably mounted on an axle 5 is provided at the rear lower portion of the can body 2. A similar caster, which is not visible in FIG. 1, is provided on the other side of the garbage can. The illustrated garbage can has a cubic capacity of 240 liters. The caster 6 is entirely accommodated within the envelope of the can body, i.e., within the imaginary continuation of the side face 7 and within the projection of the bottom 8. The casters 6 will not interfere with the nesting of the garbage can shown in the Drawing into the another garbage can.

The garbage can can conveniently be rolled on its casters although said casters are disposed within the envelope of the can body because the bottom plate 8 of the can body is connected to the rear wall 36 of the can body by an inclined wall portion 37, which defines an angular recess which is within the envelope of the can body, the garbage can can be rolled on its casters although said casters do not interfere with the nesting of the cans.

The can body 2 is provided in its upper portion with a shoulder-forming enlarged portion 9. When the garbage can shown in FIG. 1 is nested into another garbage can, the enlarged portion 9 will rest on the next lower garbage can and will thus define the spacing of the nested cans and will facilitate the separation of the nested cans. The enlarged portion 9 is constituted by an annular jacket 10, which is connected to the walls of the can body by ribs 27, which are parallel to each other and to the edges of the can body. The enlarged portion that is constituted by the annular jacket 10 extends to a lower level on the front side of the can than on the rear of the can. At the side walls 7, the lower edge of the jacket which constitutes the enlarged portion 9 is formed with an inclined step 38, which connects the wider portion to the narrower portion of the jacket.

The lateral portions 11 of the front wall of the can body 2 protrude from the intermediate portion 12 of the front wall of the can body. The intermediate portion 12 is connected to the protruding lateral portions by a small step 13, which is approximately S-shaped in cross-section and is apparent in FIG. 3. The S-shaped or wave-shaped steps constitute laterally disposed stiffening beads, which extend generally parallel to the side edges of the can body.

The cover 3 is formed with a handle recess 14 in one or each of its front corner portions. That handle recess is formed in a corner portion of the flanged cover and is covered by a handle bar 14'.

Figure 4:
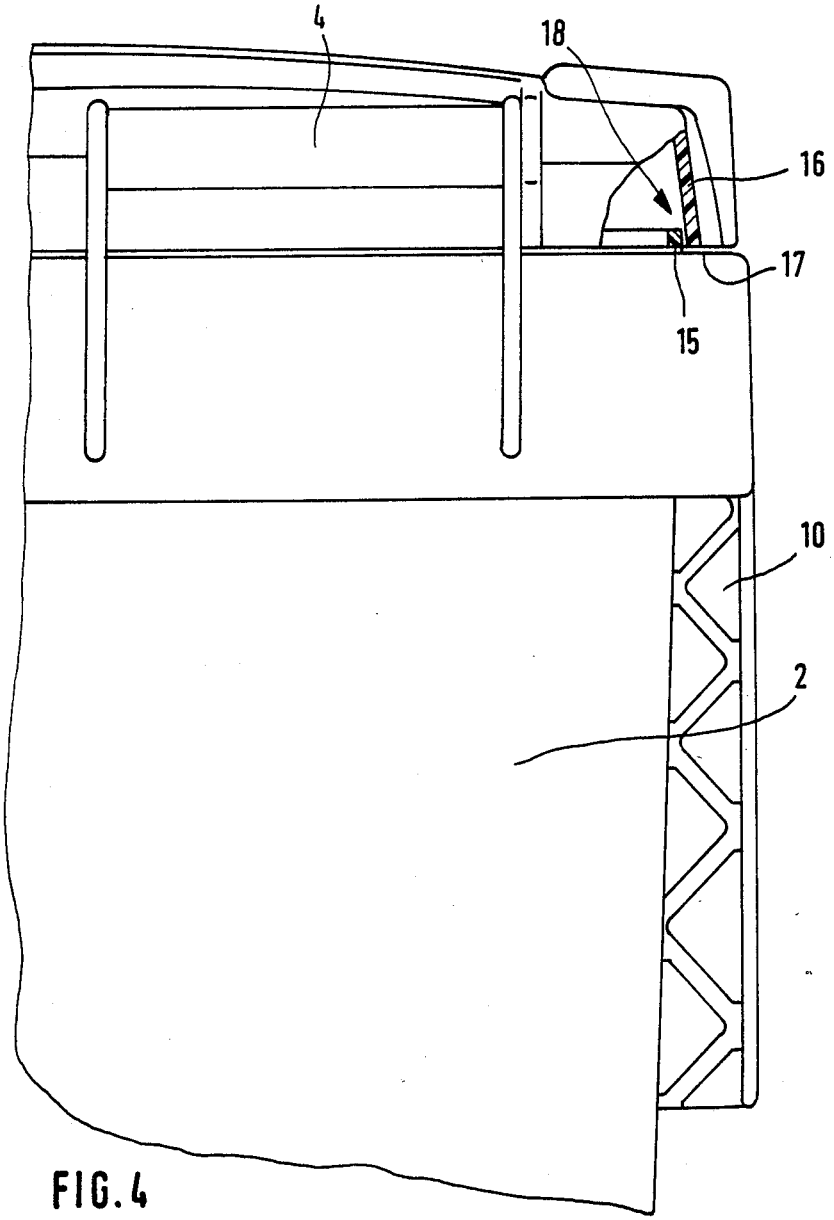
FIG. 4 is an enlarged view showing the right upper corner portion of the garbage can of FIG. 1.

The can body is formed at its top edge with an upstanding annular rib 15, which in the closed can is surrounded by the depending flat edge flange of the flanged cover 3. That overlap of the cover flange and the annular rib 15 of the can body is more clearly apparent from FIG. 4. The upstanding annular rib 15 is peripherally continuous and disposed within the depending edge flange 16 of the cover when the latter is closed so that its flange rests on the top edge 17 of the can body. The cover flange and the annular rib 15 of the can body define between them a narrow air gap. When the cover is falling down that air gap will retard the movement of the cover closely before its impact on the can body so that the noise created by the impact of the cover on the edge of the can body 2 will be damped.

Figure 2:
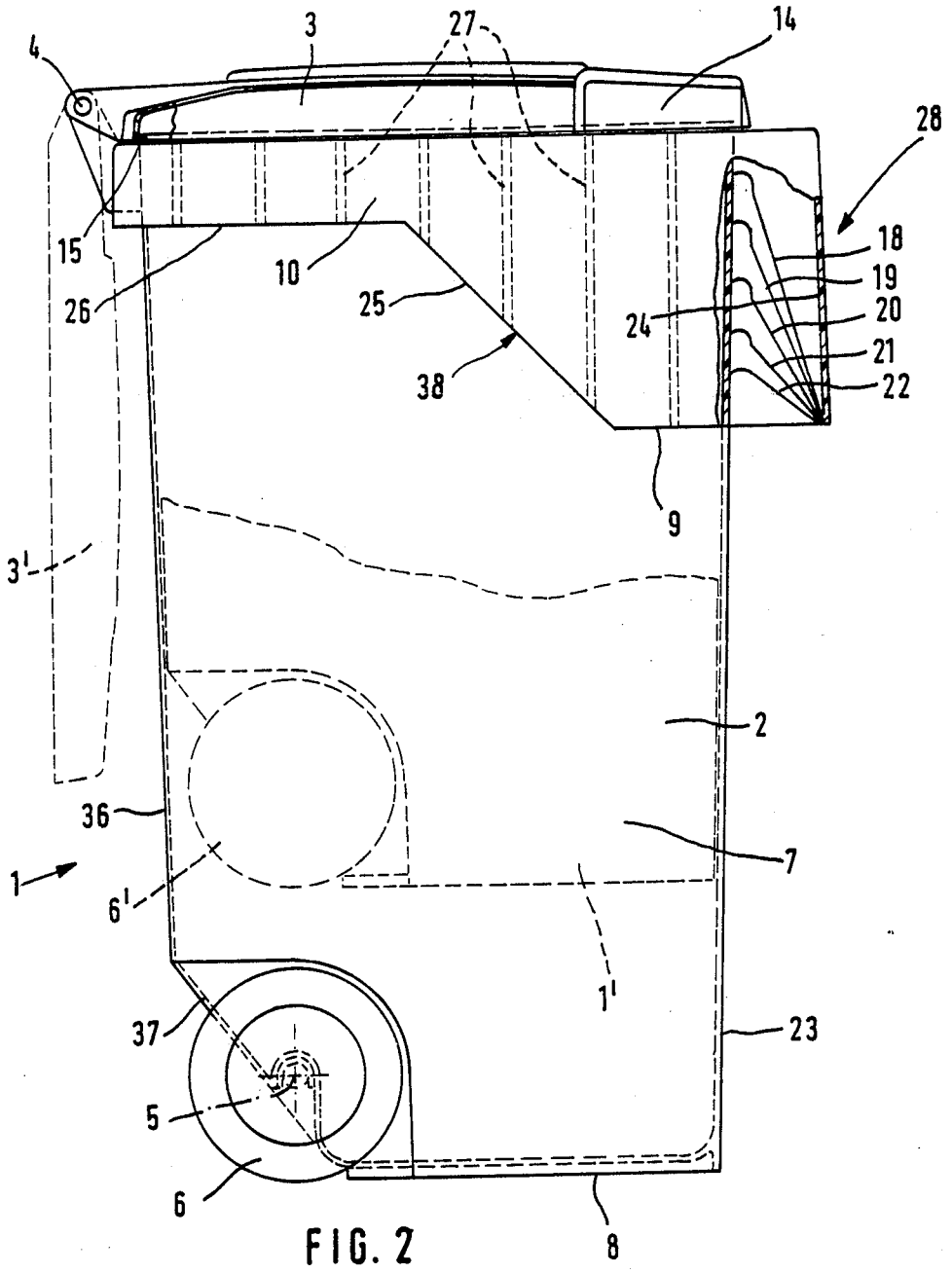
FIG. 2 is a side elevation showing the garbage can of FIG. 1.

As is apparent from FIGS. 1 and 2, the casters 6 and the recesses receiving said casters are within the envelope of the can body 2, i.e., within the imaginary continuation of the side walls and the rear wall of the can body and within the projection at the bottom.

Owing to that arrangement and a corresponding design of the bottom structure, the completely assembled cans can be nested for transportation and storage. The casters 6 are disposed within the envelope defined by the imaginary continuation of the outside surfaces of the can body and within the projection of the bottom 8 and within the imaginary continuation of the rear surface 36 so that the casters will not interfere with the nesting of a completely assembled garbage can into another. When the cans are to be nested, the cover 3 must be turned bout the axis 4 to the position that is indicated by dotted lines at 3, in FIG. 2. FIG. 2 shows a can 1 in solid lines and shows in dotted lines another can 1', which has been nested into the can 1. It is apparent that the can 1' can be nested into the can 1 in a position in which the casters 6' assume the position indicated in FIG. 2 in dotted lines at 6'. The casters 6' of the can 1' to be nested are so disposed that they will not interfere with the nesting of the can 1' into the can 1.

The shoulder-forming enlarged portion provided on the outside of the upper portion of the can body 2 will determine the spacing of the nested cans.

The can body 2 is formed in its front upper portion with a receiving pocket that is generally designated 17 and contains vertically extending, spaced apart ribs 18, 19, 20, 21, 22. The ribs have been cut away to have inwardly and downwardly facing edges which conform to the contour of the engaging surface of the member that is to be received by the pocket. That member to be received is constituted by a triangular grab claw, which has an upwardly facing tip and a horizontal bottom edge. For that purpose, the rib 18, which has the largest surface below its edge shown in FIG. 2, is disposed at the center of the front surface of the can and the ribs 19, 20, 21, 22 are disposed on both sides of the central rib 18 and are evenly spaced apart. The rib 22 is the rearmost rib in the view of FIG. 2 and will engage the outermost portion of the triangular grab claw. The inwardly and downwardly facing edges of the spaced apart vertical ribs 18 to 22 conform to the contour of the upwardly facing engaging surface of the grab claw.

The receiving pocket 17 has a smooth outer wall 24. The side walls 7 of the can body 2 are provided at their top portion on the outside with shoulder-forming bars 10, which are joined to the side walls by spaced apart vertical ribs 27, which are shown also in FIG. 1.

The cover 3 is formed on its underside in that portion which is remote from the hinge axis 4 with a handle recess 14.

The can body is formed with an upstanding annular rib 15 in that region in which the cover 3 rests on the can body 2.

Figure 5:
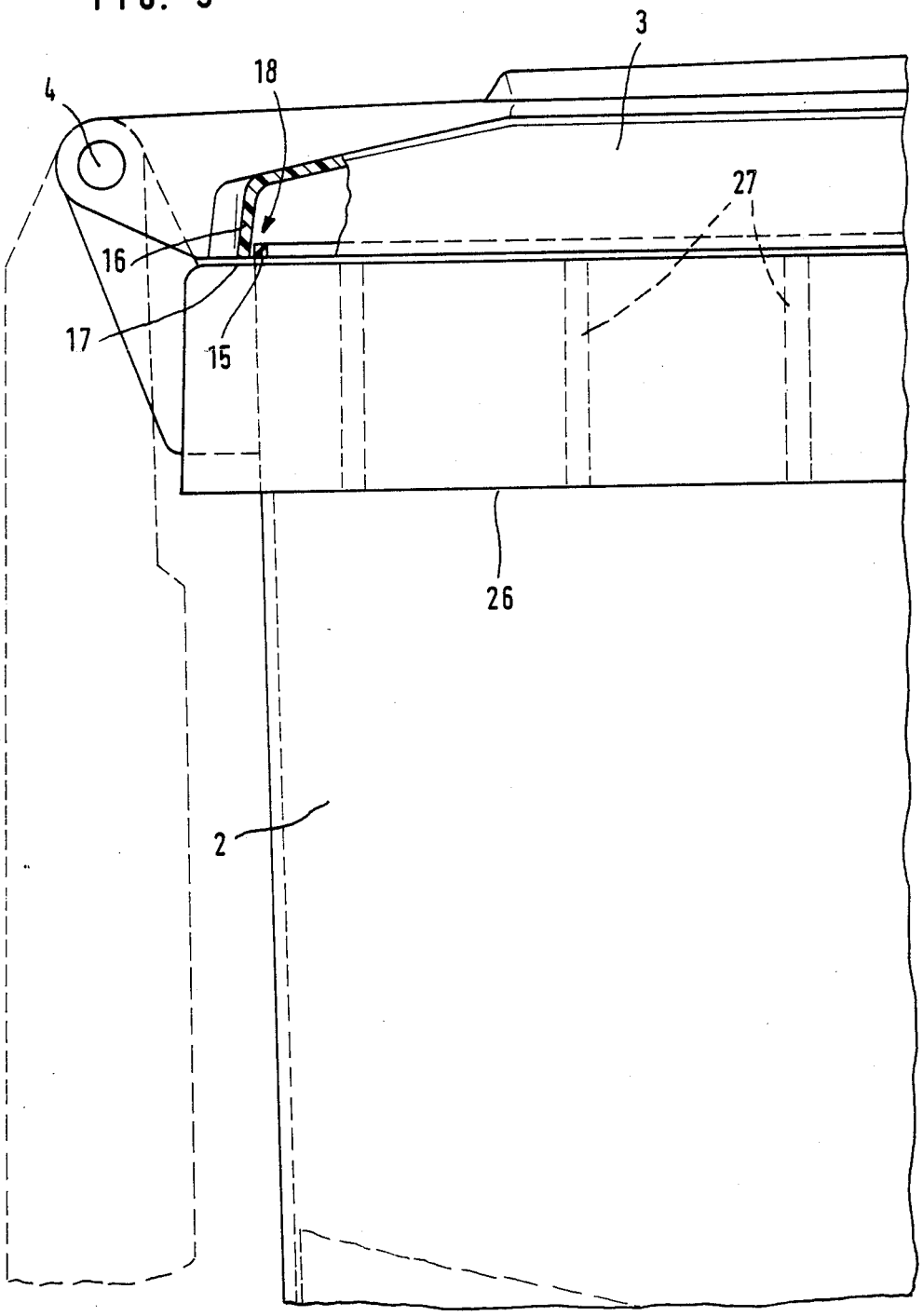
FIG. 5 is an enlarged view showing the left upper corner portion of the garbage can in a view that is similar to FIG. 2.

That detail is shown in FIG. 5 on a larger scale. Like parts are designated with the same reference characters. The reference characters of FIG. 5 correspond to those of FIG. 4 so that reference can be made to the description of FIG. 4.

The lower half of FIG. 3 is a bottom view of the garbage can of FIGS. 1 and 2 and the upper half of FIG. 3 is a top plan view of that garbage can. Like parts are again designated with the same reference characters and reference is made to the description of the remaining Figures. The space which accommodates the casters, not shown in FIG. 3, is designated 29. The casters are rotatably mounted on the axles 5 in the recess 30. It is apparent that the casters are entirely accommodated in the regions 29 contained within the envelope of the can body 2.

The front wall 23 of the can body is formed with protruding lateral portions 11, which are separated by wave-shaped vertical steps 13 from the intermediate portion 12 of the front wall of the can body.

What is claimed is:

1. A garbage can comprising a barrellike can body which is provided with front, rear and side walls, and which is substantially rectangular in cross-section and tapers downwardly to its bottom and is provided with top front, rear and side edges, a cover, which is hinged to the top rear edge of the can body, a receptacle forming a receiving pocket, which is provided adjacent to the front edge of the top opening of the can body and is adapted to receive a grab claw of a lifting and tilting mechanism, and a pair of axially aligned casters, which are eccentrically mounted adjacent to the bottom of the can body, characterized in that the bottom of the can body is connected by an inclined wall portion to the rear wall of the can body, said inclined wall portion and the bottom of the can body are formed with laterally disposed re-entrant portions, which constitute recesses, and the casters are rotatably mounted on a common axle or an aligned stub axles fitted in holders and are disposed inside the imaginary envelope of the can body which surrounds the inclined wall portion and the recesses, said can body integrally formed below its top opening with an annular peripheral jacket, which is connected by stiffening ribs to the upper wall portions of the can body, and the receiving pocket for receiving the grab claw is provided in the space between the front wall of the can body and the front portion of the jacket and said stiffening ribs are approximately parallel to each other and to the longitudinal edges of the can body, whereby said garbage can can be nested with another garbage can without interference from said casters.

2. A garbage can according to claim 1,
characterized in that the receiving pocket conforms to an approximately triangular flat rear surface and a spherically curved front surface, which is upwardly inclined from those sides of the triangle which meet at the tip and which front surface constitutes a segment of a cone and which segment is defined by an eccentric plane that is parallel to the axis of the cone.

3. A garbage can according to claim 1,
characterized in that the receiving pocket conforms to an approximately triangular grab claw, which has an upwardly facing tip and a substantially flat rear surface and a spherically curved front surface, which is upwardly inclined from those sides of the triangle which meet the top and which front surface constitutes a segment of a cone and which segment is defined by an eccentric plane that is parallel to the axis of the cone.

4. A garbage can according to claim 1,
characterized in that the can body is formed at its top edge with an inwardly offset upstanding annular rib, which, when the can is closed, is surrounded by a depending edge flange provided on the cover, said annular rib and said depending edge flange provided on said cover defining between them a narrow air gap, whereby, when the cover falls down, said air gap retards the movement thereof before its impact on said can body and dampens the noise created by the impact of said cover on said can body.

5. A garbage can according to claim 4,
characterized in that the cover is provided with a handle recess located in at least one front cover portion thereof.

6. A garbage can comprising a barrellike can body, which is substantially rectangular in cross-section and tapers downwardly to its bottom, a cover, which is hinged to the top rear edge of the can body, a receptacle, which is provided adjacent to the front edge of the top opening of the can body and is adapted to receive a grab claw of a lifting and tilting mechanism, and a pair of axially aligned casters, which are eccentrically mounted adjacent to the bottom of the can body,
characterized in that the can body is integrally formed below its top opening with an annular peripheral jacket, which is connected by stiffening ribs to the upper wall portions of the can body, and a pocket for receiving the grab claw is provided in the space between the front wall of the can body and the front portion of the jacket.

7. A garbage can according to claim 6,
characterized in that the stiffening ribs are approximately parallel to each other and to the edges of the can body.

8. A garbage can according to claim 6,
characterized in that the front wall of the can body is inwardly re-entrant from the side edges and the transitions between the re-entrant portion of the front wall and the side edges are constituted by steps which have a flat S-shaped configuration in horizontal section and constitute stiffening beads.

9. A garbage can according to claim 6,
characterized in that the jacket is narrower on the rear than on the front side of the can and the side portions of the jacket are formed with an inclined step between the wider portion and the narrower portion.

10. A garbage can according to claim 6,
characterized in that the cover is formed with a handle recess in at least one of its front corner portions.

11. A garbage can comprising a barrellike can body, which is substantially rectangular in cross-section and tapers downwardly to its bottom and is provided with top front, rear and side edges, a cover, which is hinged to the top rear edge of the can body, a receptacle forming a receiving pocket, which is provided adjacent to the front edge of the top opening of the can body and is adapted to receive a grab claw of a lifting and tilting mechanism, and a pair of axially aligned casters, which are eccentrically mounted adjacent to the bottom of the can body, characterized in that the bottom of the can body is connected by an inclined wall portion to the rear wall of the can body, said inclined wall portion and the bottom of the can body are formed with laterally disposed re-entrant portions, which constitute recesses, and the casters are rotatably mounted on a common axle or on aligned stub axles fitted in holders and are disposed inside the imaginary envelope of the can body which surrounds the inclined wall portion and the recesses, the can body being integrally formed below its top opening with an annular peripheral jacket, which is connected by stiffening ribs to the upper wall portions of the can body, and the receiving pocket for receiving the grab claw is provided in the space between the front wall of the can body and the front portion of the jacket.

12. A garbage can comprising a barrellike can body provided with front, rear and side walls, and which is substantially rectangular in cross-section and tapers downwardly to its bottom and is provided with top front, rear and side edges, a cover, which is hinged to the top rear edge of the can body, a receptacle forming a receiving pocket, which is provided adjacent to the front edge of the top opening of the can body and is adapted to receive a claw of a lifting and tilting mechanism, and a pair of axially aligned casters, which are eccentrically mounted adjacent to the bottom of the can body, characterized in that the bottom of the can body is connected by an inclined wall portion to the rear wall of the can body, said inclined wall portion and the bottom of the can body are formed with laterally disposed re-entrant portions, which constitute recesses, and the casters are rotatably mounted on a common axle or on aligned stub axles fitted in holders and are disposed inside the imaginary envelope of the can body which surrounds the inclined wall portion and the recesses, the receiving pocket conforming to an approximately triangular grab claw, which has an upwardly facing tip and a substantially flat rear surface and a spherically curved front surface, which is upwardly inclined from those sides of the triangle which meet at the tip and which front surface constitutes a segment of a cone and which segment is defined by an eccentric plane that is parallel to the axis of the cone, stiffening ribs provided on the upper front wall portion of the can body, said ribs being cut away to form inwardly and downwardly facing edges, which conform to the contour of the receiving pocket which ha a spherically curved front surface.

13. A garbage can comprising a barrellike can body provided with front, rear and side walls, and which is substantially rectangular in cross-section and tapers downwardly to its bottom and is provided with top front, rear and side edges, a cover, which is hinged to the top rear edge of can body, a receptacle forming a receiving pocket, which is provided adjacent to the front edge of the opening of the can body and is adapted to receive a grab claw of a lifting and tilting mechanism, and pair of axially aligned casters, which are eccentrically mounted adjacent to the bottom of can body, characterized in that the bottom of the can body is connected by an inclined wall portion to the rear wall of the can body, said inclined wall portion and the bottom of the can body are formed with laterally disposed re-entrant portions, which constitute recesses, and the casters are rotatably mounted on a common axle or on aligned stub axles fitted in holders and are disposed inside the imaginary envelope of the can body which surrounds the inclined wall portion and the recesses, the front wall of the can body being inwardly re-entrant from the side edges thereof and the transitions between the re-entrant portion of the front wall and the side edges being constituted by steps which have a flat S-shape configuration in horizontal section and which constitute stiffening beads.

14. A garbage can comprising a barrellike can body provided with front, rear and side walls, and which is substantially rectangular in cross-section and tapers downwardly to its bottom and is provided with top front, rear and side edges, a cover, which is hinged to the top rear edge of the can body, a receptacle forming a receiving pocket, which is provided adjacent to the front edge of the top opening of the can body and is adapted to receive a grab claw of a lifting and tilting mechanism, and a pair of axially aligned casters, which are eccentrically mounted adjacent to the bottom of the can body, characterized in that the bottom of the can body is connected by an inclined wall portion to the rear wall of the can body, said inclined wall portion and the bottom of the can body are formed with laterally disposed re-entrant portions, which constitute recesses, and the casters are rotatably mounted on a common axle or on aligned stub axles fitted in holders and are disposed inside the imaginary envelope of the can body which surrounds the inclined wall portion and the recesses, the can body being integrally formed below its top opening with an annular peripheral jacket, which is connected by stiffening ribs to upper wall portions of the can body, and the receiving pocket for receiving the grab claw is provided in the space between the front wall of the can body and the front portion of the jacket, the jacket being narrower on the rear side of the can than on the front side of the can and the side portions of the jacket being formed with an inclined step between the wider front portion and the narrower rear portion.

15. A garbage can comprising a barrellike can body provided with front, rear and side walls, and which is substantially rectangular in cross-section and tapers downwardly to its bottom and is provided with top front, rear and side edges, a cover, which is hinged to the top rear edge of the can body, a receptacle forming a receiving pocket, which is provided adjacent to the front edge of the top opening of the can body and is adapted to receive a grab claw of a lifting and tilting mechanism, and a pair of axially aligned casters, which are eccentrically mounted adjacent to the bottom of the can body, characterized in that the bottom of the can body is connected by an inclined wall portion to the rear wall of the can body, said inclined wall portion and the bottom of the can body are formed with laterally disposed re-entrant portions, which constitute recesses, and the casters are rotatably mounted on a common axle or on aligned stub axles fitted in holders and are disposed inside the imaginary envelope of the can body which surround the inclined wall portion and the recesses, the can body being formed at its top edge with an inwardly offset upstanding annular rib which, when the can is closed, is surrounded by a depending edge flange provided on the cover.

16. A garbage can comprising a barrellike can body provided with front, rear and side walls, and which is substantially rectangular in cross-section and tapers downwardly to its bottom and is provided with top front, rear and side edges, a cover, which is hinged to the top rear edge of the can body, a receptacle forming a receiving pocket, which is provided adjacent to the front edge of the top opening of the can body and is adapted to receive a grab claw of a lifting and tilting mechanism, and a pair of axially aligned casters which are eccentrically mounted adjacent to the bottom of the can body, characterized in that the bottom of the can body is connected by an inclined wall portion to the rear wall of the can body, said inclined wall portion and the bottom of the can body are formed with laterally disposed re-entrant portions, which constitute recesses, and the casters are rotatably mounted on a common axle or on aligned stub axles fitted in holders and are disposed inside the imaginary envelope of the can body which surrounds the inclined wall portion and the recesses, the cover being provided with a handle recess located in at least one front corner portion thereof.

17. A garbage can comprising a barrellike can body provided with front, rear and side walls, and which is substantially rectangular in cross-section and tapers downwardly to its bottom and is provided with top front, rear and side edges, a cover, which is hinged to the top rear edge of the can body, a receptacle forming a receiving pocket, which is provided adjacent to the front edge of the top opening of the can body and is adapted to receive a grab claw of a lifting and tilting mechanism, and a pair axially aligned casters, which are eccentrically mounted adjacent to the bottom of the can body, characterized in that the receiving pocket conforms to approximately triangular grab claw, which has an upwardly facing tip and a substantially flat rear surface and a spherically curved front surface, which is upwardly inclined from those sides of the triangular which meet the tip and which front surface constitutes a segment of a cone and which segment is defined by an eccentric plane that is parallel to the axis of the cone, stiffening ribs being provided on the upper front wall portion of the can body and said ribs being cut away to form inwardly and downwardly facing edges, which conform to the contour of the receiving pocket which has a spherically curved front surface.

18. A garbage can comprising a barrellike can body provided with front, rear and side walls, and which is substantially rectangular in cross-section and tapers downwardly to its bottom and is provided with top front, rear and side edges, a cover, which is hinged to the top rear edge of the can body, a receptacle forming a receiving pocket, which is provided adjacent to the front edge of the top opening of the can body and is adapted to receive a crab claw of a lifting and tilting mechanism, and a pair of axially aligned casters, which are eccentrically mounted adjacent to the bottom of the can body, characterized in that the receiving pocket conforms to an approximately triangular grab claw, which has an upwardly facing tip and a substantially flat rear surface and a spherically curved front surface, which is upwardly inclined from those sides of the triangular which meet the tip and which front surface constitutes a segment of a cone and which segment is defined by an eccentric plane that is parallel to the access of the cone, the front wall of the can body being inwardly re-entrant from the side edges thereof and the transitions between the re-entrant portions of the front wall and the side edges are constituted by steps which have a flat S-shaped configuration in horizontal section and constitute stiffening heads.

19. A garbage can comprising a barrellike can body provided with front, rear and side walls, and which is substantially rectangular in cross-section and tapers downwardly to its bottom and is provided with top front, rear and side edges, a cover, which is hinged to the top rear edge of the can body, a receptacle forming a receiving pocket, which is provided adjacent to the front edge of the top opening of the can body and is adapted to receive a grab claw of a lifting and tilting mechanism, and a pair of axially aligned casters, which are eccentrically mounted adjacent to the bottom of the can body, characterized in that the receiving pocket conforms to an approximately triangular grab claw, which has an upwardly facing tip and a substantially flat rear surface and a spherically curved front surface, which is upwardly inclined from those sides of the triangle which meet the tip and which front surface constitutes a segment of a cone and which segment is defined by an eccentric plane that is parallel to the axis of the cone, the cover being provided with a handle recess located in at least one front corner portion thereof.

* * * * *